US005599081A

United States Patent [19]

Revlett et al.

[11] Patent Number: 5,599,081

[45] Date of Patent: Feb. 4, 1997

[54] REFRIGERATION APPLIANCE DOOR WITH REINFORCEMENT SHEET

[75] Inventors: John R. Revlett, Henderson County, Ky.; Edward A. Anderson; Patrick A. Braun, both of Warrick County, Ind.; Steve J. Kerwin; Franklin G. Katje, both of Evansville, Ind.

[73] Assignee: Whirlpool Corporation, Benton Harbor, Mich.

[21] Appl. No.: 599,639

[22] Filed: Feb. 9, 1996

Related U.S. Application Data

[63] Continuation of Ser. No. 287,040, Aug. 8, 1994, abandoned.

[51] Int. Cl.[6] ..... A47B 96/04

[52] U.S. Cl. ..... 312/406; 312/405.1

[58] Field of Search ..... 312/400, 401, 312/406, 404, 405, 405.1, 408; 52/309.7

[56] References Cited

U.S. PATENT DOCUMENTS

| | | | |
|---|---|---|---|
| 2,612,661 | 10/1952 | Semple . | |
| 2,764,785 | 10/1956 | Sulcek . | |
| 3,078,003 | 2/1963 | Kesling . | |
| 4,107,833 | 8/1978 | Knight et al. | 312/406 |
| 4,190,305 | 2/1980 | Knight et al. . | |
| 4,536,990 | 8/1985 | Siegrist et al. . | |
| 4,740,042 | 4/1988 | Stich et al. . | |
| 4,747,245 | 5/1988 | Lesmeister et al. . | |
| 4,779,939 | 10/1988 | Stich . | |
| 4,787,133 | 11/1988 | Lesmeister et al. . | |

FOREIGN PATENT DOCUMENTS

| | | | |
|---|---|---|---|
| 599032 | 1/1984 | Japan . | |
| 1200184 | 1/1989 | Japan . | |
| 2-040482 | 2/1990 | Japan | 312/400 |

*Primary Examiner*—Peter M. Cuomo
*Assistant Examiner*—Gerald A. Anderson
*Attorney, Agent, or Firm*—Thomas J. Roth; Mark A. Davis

[57] ABSTRACT

A door construction is provided for a refrigeration appliance where the door has an exterior shell with a certain degree of rigidity, an interior liner spaced from the exterior shell and being less rigid than the shell, a foamed insulation material disposed between the exterior shell and the interior liner and a reinforcement sheet having a rigidly greater than the liner located between the exterior shell and the liner. The reinforcement sheet may either be retained and placed by the foamed insulation material or by an adhesive layer between the sheet and the liner. Preferably the liner has a planar surface and the sheet has a planar surface in engagement with the planar surface of the liner. The sheet may be non-perforated or perforated and be made of a metallic material.

20 Claims, 2 Drawing Sheets

FIG. 2
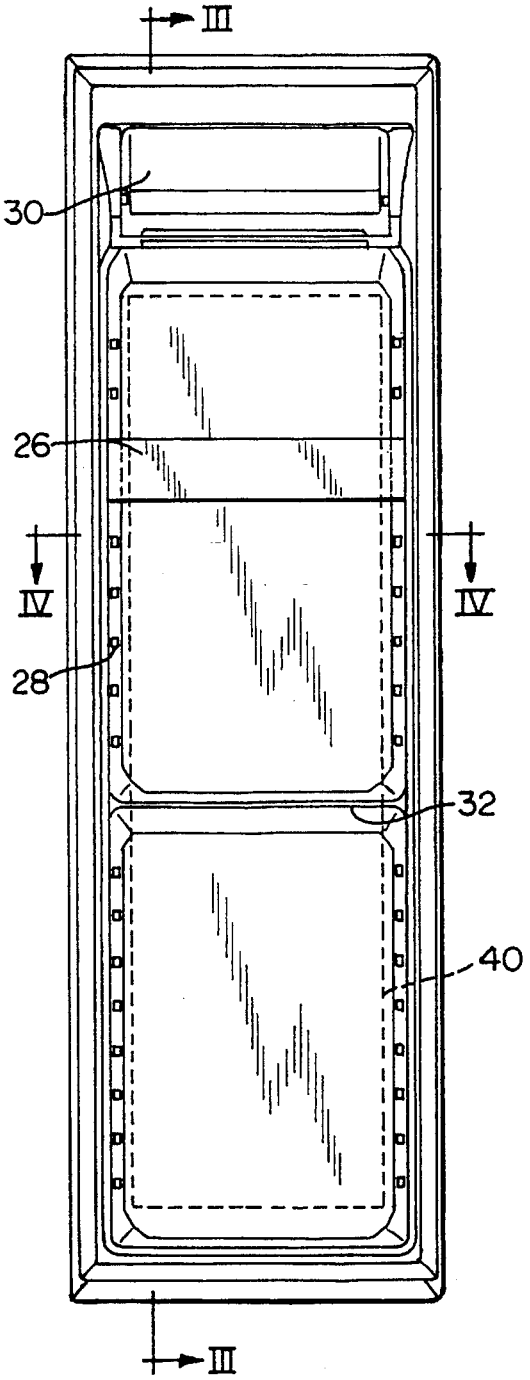
FIG. 5
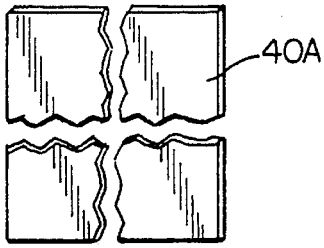
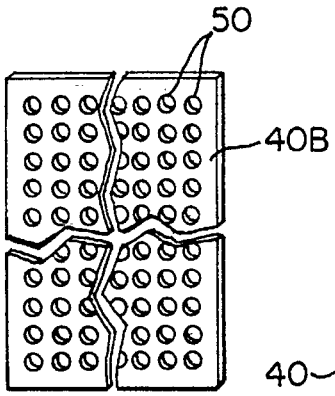
FIG. 6
FIG. 3
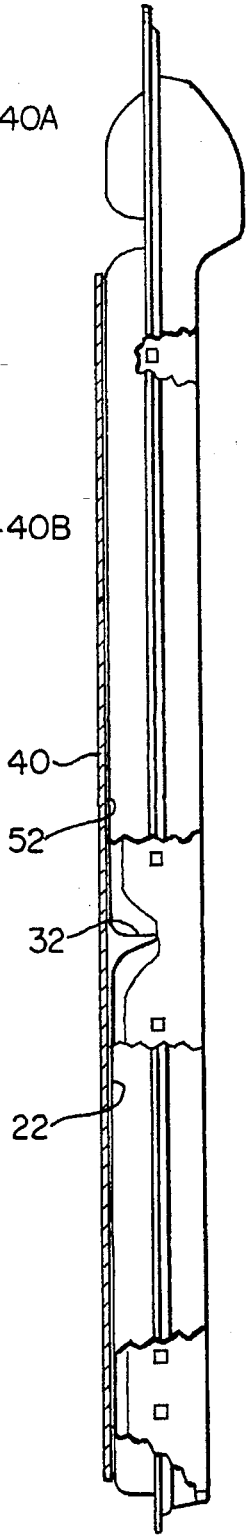

REFRIGERATION APPLIANCE DOOR WITH REINFORCEMENT SHEET

This is a continuation of application Ser. No. 08/287,040, filed Aug. 8, 1994, now abandoned.

BACKGROUND OF THE INVENTION

The present invention relates to the construction of a refrigerator door for a refrigeration appliance and more particularly to construction of such a door to prevent racking of the door.

It is common in refrigerator door constructions to utilize an exterior door panel formed of metal such as sheet steel and to provide a separate liner wall of a thin material such as plastic. In between the exterior panel and the interior liner a foam material is injected which expands and hardens to providing insulation and rigidity to the door.

When the door is loaded with food items in the shelves formed in the liner, the refrigerator door tends to twist and thus at the lower handle corner opposite the hinge side, the gap between the door and the cabinet can increase to the point that the gasket seal is broken. It therefore would be an improvement in the art if provision were made for increasing the rigidity of the door to overcome the twisting of the door.

SUMMARY OF THE INVENTION

The present invention provides an improvement in refrigerator door construction by utilizing a reinforcement sheet which can be a plain or perforated flat panel located between the foamed insulation material and the plastic inner liner. The sheet would be retained in place by the foamed insulation material or could be adhesively attached to the inner liner. Thus, no special machining or dimensioning is required for the sheet nor are any separate fasteners required to hold the sheet in place within the door.

The reinforcement sheet could be formed of a plastic material or of a metal material such as steel. Any material would work so long as it has more rigidity than the inner door panel material and will also adhere to the foam.

BRIEF DESCRIPTION OF THE DRAWINGS

FIG. 2 is an inside elevational view of the refrigerator door embodying the principles of the present invention.

FIG. 3 is a side sectional view taken generally along the line III—III of FIG. 2.

FIG. 5 is a partial view of a first embodiment of the reinforcing sheet of the present invention.

FIG. 6 is a partial view of a second embodiment of the reinforcement sheet of the present invention.

DETAILED DESCRIPTION OF THE PREFERRED EMBODIMENTS

Figure 1:
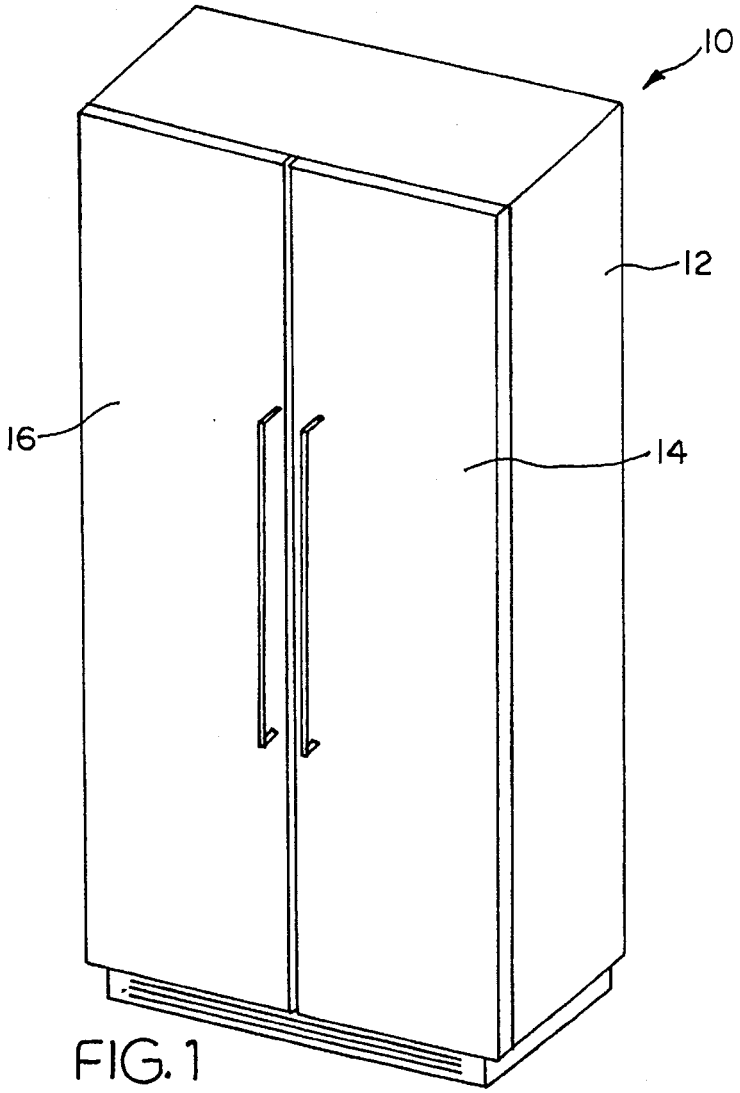
FIG. 1 is a perspective view of a refrigerator embodying the principles of the present invention.

In FIG. 1 there is illustrated, by way of example, a refrigeration appliance generally at 10 which comprises a cabinet 12 having a first door 14 for accessing a refrigerator compartment and a second door 16 for accessing a freezer compartment. The particular refrigeration appliance illustrated is only a single example of a type of refrigeration appliance that could utilize the present invention. Other configurations of refrigeration appliances such as single door refrigerators, single door freezers or arrangements where the refrigerator and freezer doors are positioned one above the other could also make use of the present invention.

Figure 4:
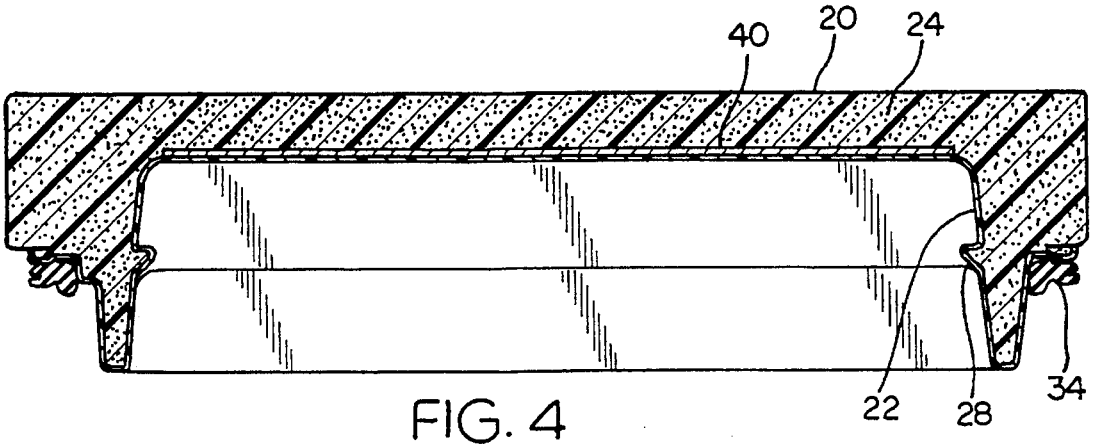
FIG. 4 is a sectional view taken generally along the line IV—IV of FIG. 2.

FIGS. 2–4 illustrate a typical door construction.

The doors are provided with an exterior shell 20 and an interior liner wall 22 which is spaced with the exterior shell 20. A space 24 between the liner 22 and shell 20 is normally filled with an insulation material such as polyurethane foam which is injected into the space in a liquid state where it expands and hardens into a porous solid state to form a structural part of the cabinet as well as providing a thermal barrier necessary to prevent rapid warming of the interior compartments.

Typically the outer shell 20 is formed from steel or some similar rigid material and is bent or formed to comprise a six sided rectangular box with one open side which accommodates the liner 22. The liner 22 typically is of a light weight thin sheet plastic material having sufficient strength, however, to support one or more shelves 26 thereon, such as by means of protruding tabs 28 formed in the liner or, in some constructions, by means of apertures formed in the liner to receive lugs carried on the shelves 26.

The liner may also be provided with other specific configurations such as to provide a compartment area 30 typically used for dairy products or to provide an air dam 32 to reduce the downward flowing of cold air from the evaporator into the lower area of the refrigerator compartment.

In the interests of cost efficiencies and providing refrigeration appliances to the consumer at the best price value, typically the exterior shell 20 and liner 22 are fabricated of the thinnest gauge material possible to still accommodate the functions to be provided by the door, which is to seal off the large front opening of the refrigeration compartment as well as to provide a structure for receiving shelves and other storage compartments for food items.

However, if the food items placed within the door shelves exceed a certain weight limit, the torsional forces caused by the loading will begin to distort the shape of the door, causing it to rack or twist and causing a gasket 34 which is used to seal the door to the opening of the refrigeration cabinet, to lift away from the cabinet, permitting a leakage of refrigerated air, thereby reducing the efficiency of the refrigeration appliance. To overcome this problem Applicant has discovered that the insertion of a sheet of material 40 into the space 24 and lying against an interior surface of the liner 22 will significantly increase the overall rigidity of the door, thus preventing undesirable racking of the door.

The sheet 40 is shown in FIGS. 2, 3 and 4 as being laid against an inside surface of the liner 22 and having a width and height to generally cover a major planar portion of the liner wall. In a first embodiment of the sheet 40, the sheet is formed as a plain solid panel **40*a* as seen in FIG. 5. Alternatively, a panel 40*b* can be perforated as at 50 shown in FIG. 6. The particular size and placement of the perforations 50 will be determinable based upon the particular size and configuration of the door being made more rigid. By using either sheet 40*a*, 40*b* laid up against the liner 22, the sheet, which should have a rigidity greater than the material of the liner, in essence closes the sixth face of the box created by the exterior shell 20** thereby improving torsional rigidity leading to reduced distortion of the door under load.

The sheet 40 can simply be laid against the liner 22, allowing the foam to hold the sheet in place, or, an adhesive layer 52 may be provided between the sheet 40 and the liner 22 to provide a secure attachment of the sheet 40 to the liner 22.

When a perforated sheet such as 40*b* is utilized, relatively unobstructed foam flow into all portions of the door cavity is provided and also the inner door-to-foam contact area is maximized. Thus, foam is permitted to flow into such areas as the space behind the air dam 32 and also allows for direct contact over a much greater area of the foam to the liner.

The use of the reinforcement sheet 40 is applicable to foamed-in-place door constructions as well as in the manufacturing operation where foam insulation is poured into an open face of the exterior door before the liner is assembled.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A door for a refrigeration appliance having a cabinet with a least one compartment defined by a peripheral edge, the door comprising:

an exterior shell with a peripheral edge and having an outer surface and an inner surface, a certain degree of rigidity, and a seal provided on the peripheral edge to seal the door with respect to a refrigeration appliance, an interior liner comprising a peripheral edge and a planar portion and having a front surface and a rear surface, the planar portion of the interior liner being spaced from the exterior shell and being less rigid than the shell, at least one shelf being provided on the front surface of the interior liner, a foamed insulation material disposed between the inner surface of the exterior shell and the rear surface of the interior liner, and a reinforcement sheet provided on and substantially coextensive with the planar portion of the inner liner and having a rigidity greater than said interior liner, wherein the combined rigidity of the inner liner and the sheet material is such that upon the loading of the shelf, the interior liner is sufficiently rigid to prevent the torsional forces associated with the loading of the shelf from deforming the door to break the seal between the seal and a refrigeration appliance.

2. A door according to claim 1, wherein said reinforcement sheet is retained in place by said foamed insulation material.

3. A door according to claim 1, wherein said reinforcement sheet is retained in place by an adhesive layer between said sheet and said liner.

4. A door according to claim 1, wherein said exterior shell is formed of metal.

5. A door according to claim 1, wherein said interior liner is formed of plastic.

6. A door according to claim 1, wherein said reinforcement sheet has a planar surface in engagement with a planar surface of said liner.

7. A door according to claim 1, wherein said reinforcement sheet is a non-perforated sheet of material.

8. A door according to claim 1, wherein said reinforcement sheet is a perforated sheet of material.

9. A door according to claim 1, wherein said reinforcement sheet is formed of metal.

10. A door for a refrigeration appliance having a cabinet with a least one compartment defined by a peripheral edge, the door comprising:

an exterior shell having a certain degree of rigidity, the exterior shell having a front wall with a peripheral sidewall having a peripheral edge to form an open box, the box having an outer surface and an inner surface, an interior liner having a planar portion with a peripheral sidewall having a peripheral edge, the interior liner having a front surface and a rear surface, the planar surface area being spaced from the inner surface of the exterior shell, the interior liner being less rigid than said shell and being positioned adjacent to the open side of the box and the peripheral edge of the interior liner and the peripheral edge of the interior liner form a peripheral edge of the door, a seal is provided on the peripheral edge of the door, at least one shelf being provided on the front surface of the interior liner, a foamed insulation material disposed between the inner surface of the exterior shell and front surface of the interior liner, and a reinforcement sheet being substantially coextensive and coplanar with the planar surface of the interior liner and having a rigidity greater than said liner located between said exterior shell and said liner, in flat engagement with said planar surface area of said liner, wherein the combined rigidity of the inner liner and the sheet material is such that upon the loading of the shelf, the interior liner is sufficiently rigid to prevent the torsional forces associated with the loading of the shelf from deforming the door to break the seal between the seal and a refrigeration appliance.

11. A door according to claim 10, wherein said reinforcement sheet is retained in place by said foamed insulation material.

12. A door according to claim 10, wherein said reinforcement sheet is retained in place by an adhesive layer between said sheet and said liner.

13. A door according to claim 10, wherein said exterior shell is formed of metal.

14. A door according to claim 10, wherein said interior liner is formed of plastic.

15. A door according to claim 10, wherein said reinforcement sheet is a non-perforated sheet of material.

16. A door according to claim 10, wherein said reinforcement sheet is a perforated sheet of material.

17. A door according to claim 10, wherein said reinforcement sheet is formed of metal.

18. A door for a refrigeration appliance having a cabinet with at least one compartment defined by a peripheral edge, the door comprising:

an exterior metal shell having a certain degree of rigidity and forming a box with an open side, defining a peripheral edge, a seal provided on the peripheral edge of the door for sealing a compartment of a refrigerator by contacting a peripheral edge of a refrigerator cabinet when the door is mounted on a refrigerator, an interior plastic liner having a planar surface area spaced from the exterior shell, being less rigid than said shell and being positioned to close said open side of said box, at least one shelf being provided on the front surface of the interior liner, a foamed insulation material disposed between the exterior shell and the interior liner, and a flat reinforcement sheet being substantially coextensive with the planar surface of the interior plastic liner having a rigidity greater than said liner located between said exterior shell and said liner, and in flat engagement with said planar surface area of said liner, wherein the combined rigidity of the inner liner and the sheet material is such that upon the loading of the shelf, the interior liner is sufficiently rigid to prevent the torsional forces associated with the loading of the shelf from deforming the door to break the seal between the seal and a refrigeration appliance.

19. A door according to claim 18, wherein said reinforcement sheet is retained in place by an adhesive layer between said sheet and said liner.

20. A door according to claim 18, wherein said reinforcement sheet is a perforated sheet of material.

* * * * *